US005231957A

United States Patent [19]

Eckel et al.

[11] Patent Number: 5,231,957

[45] Date of Patent: Aug. 3, 1993

[54] RESILIENT CONNECTING DEVICE BETWEEN AN INTERNAL COMBUSTION ENGINE AND AN INTAKE PIPE THEREOF

[75] Inventors: Hans-Gerd Eckel, Laudenbach; Klaus Kurr, Weinheim-Hohensachsen; Armin Barth, Gorxheimertal; Karl-Heinrich Spies, Birkenau, all of Fed. Rep. of Germany

[73] Assignee: Firma Carl Freudenberg, Weinheim/Bergstrasse, Fed. Rep. of Germany

[21] Appl. No.: 880,105

[22] Filed: May 6, 1992

[30] Foreign Application Priority Data

Jul. 31, 1991 [DE] Fed. Rep. of Germany ..... 4125249

[51] Int. Cl.[5] ..... F02M 35/10

[52] U.S. Cl. ..... 123/52 M; 248/635; 267/293

[58] Field of Search ..... 123/52 M, 52 MC; 248/562, 575, 634, 635, 622, 632; 267/292, 293, 141, 141.2, 141.3

[56] References Cited

U.S. PATENT DOCUMENTS

| | | | |
|---|---|---|---|
| 4,468,016 | 8/1984 | Pineau | 267/292 |
| 4,708,097 | 11/1987 | Hatamura et al. | 123/52 M |
| 4,711,423 | 12/1987 | Popper | 248/635 |
| 4,776,313 | 10/1988 | Freismuth et al. | 123/52 M |
| 4,886,020 | 12/1989 | Bitter et al. | 123/52 M |
| 4,995,598 | 2/1991 | Ingham | 248/635 |
| 5,012,770 | 5/1991 | Okamoto et al. | 123/52 MC |

FOREIGN PATENT DOCUMENTS

| | | | |
|---|---|---|---|
| 2317856 | 11/1974 | Fed. Rep. of Germany | 267/293 |
| 3641811 | 5/1988 | Fed. Rep. of Germany . | |
| 1343717 | 10/1963 | France | 123/52 M |
| 0082567 | 5/1984 | Japan | 123/52 M |
| 0009041 | 1/1987 | Japan | 267/293 |

*Primary Examiner*—David A. Okonsky
*Attorney, Agent, or Firm*—Sprung Horn Kramer & Woods

[57] ABSTRACT

A resilient connecting device between an internal combustion engine and an intake pipe thereof comprises an annular cushion of resilient material and two mounting elements that are coaxial with it and fastened to the components being connected. The cushion is axially demarcated at each face by supporting surfaces that extend essentially perpendicular to its axis. The mounting elements overlap and contact the supporting surfaces. A cup spring, made of a material that does not creep, is aligned with the ring.

10 Claims, 2 Drawing Sheets

RESILIENT CONNECTING DEVICE BETWEEN AN INTERNAL COMBUSTION ENGINE AND AN INTAKE PIPE THEREOF

BACKGROUND OF THE INVENTION

The invention concerns a resilient connecting device between an internal combustion engine and an intake pipe thereof. The connecting device comprises an annular "cushion" of resilient material and two mounting elements that are coaxial with it and fastened to the components being connected.

A connecting device of this type is known from German Patent No. 3,641,811. Resilient mounting elements between the intake system and the cylinder head of a internal combustion engine isolate vibrations. The mounting elements, however, are difficult to reach, which makes assembly slower and more complicated.

SUMMARY OF THE INVENTION

The principal object of the present invention is to provide a resilient connecting device of the type described above that makes possible a quick and simple connection of an intake pipe to an internal combustion engine while reliably isolating vibrations over a long life and at all the temperatures that occur during normal operation.

This object, as well as other objects which will become apparent from the discussion that follows, are achieved, in accordance with the present invention, by providing a connecting device wherein the cushion is axially demarcated at each face by supporting surfaces that extend essentially perpendicular to its axis. The mounting elements overlap and contact the supporting surfaces. A cup spring, made of a material that does not creep, is aligned with the ring.

One advantage of this arrangement according to the invention is that, since the cup spring is comparatively flat, the overall assembly can fit into the shallower engine compartments of contemporary, increasingly more aerodynamic automobiles. Another advantage of the cup spring is that the connecting device will have a longer life and operate more reliably. Any relaxation on the part of the cushion's resilient material will be compensated for by the cup spring.

The tension on the cup spring can be essentially zero once the connecting device has been installed. The spring will then be substantially flattened. It is preferably made of either fiber-reinforced plastic or steel. The cup spring also preferably has an S-shaped characteristic curve, and any deformation that occurs in the absence of vibrations, once the connecting device has been installed, can occur in the essentially horizontal section of the curve. Any noise-generating vibrations that occur while the engine is in operation will then be almost completely isolated and uncoupled. Lower-frequency vibrations with longer amplitudes will be reliably suppressed by the cushion and by the disengaged cup spring.

A cup spring with an S-shaped characteristic and a resilience matching that of the cushion will maintain the operating properties of the connecting device constant and unaffected by temperature. This feature is particularly important in the vicinity of an internal combustion engine's cylinder head, where especially high temperatures can occur.

Prerequisite to an S-shaped characteristic is that the spring be made of a material that does not creep, of fiber-reinforced plastic or of steel for example. An initial regressive section of the chracteristic is followed by a definitely pronounced stretch where considerable displacements occur even when the load that is to be accommodated changes very little. This stretch, in turn, is followed by another section of increased slope, although in the other direction, i.e., a progressive section of the curve. Outside the definitely pronounced stretch it will take considerably stronger forces to deform the spring.

The function of the cushion of resilient material in the connecting device in accordance with the invention is to reliably suppress longer-amplitude vibrations. The cushion does nothing to counteract noise-generating vibrations of shorter amplitude, which are isolated by the tensioned cup spring. Lower-frequency vibrations of longer amplitude are suppressed by both the cushion and the displaced cup spring. The suppression of low-frequency vibrations and the isolation of noise-generating high-frequency over a long period of time, even at high temperatures, are accordingly easy.

A pot-shaped axial projection on the second mounting element extends essentially through the center of the first mounting element without coming into contact with it. The radial gap between the projection and the first mounting element is extensive enough to ensure that vibrations at a right angle to the axis of the connecting device can be adequately isolated without slight displacement of the two mounting elements leading to contact and accordingly to clattering.

In one embodiment distinguished for its particular compactness, the cup spring is accommodated both on the side of the first mounting element facing away from the cushion and in a supporting fitting that extends axially along the two mounting elements and the cushion. One advantage of this approach is that the supporting fitting will protect both the mounting elements and the annular cushion of resilient material from contamination, improving the operating characteristics even more.

The supporting fitting can have at least one air outlet distributed along its circumference in the axial vicinity of the cushion. Air outlets will ensure even more effective vibration suppression and isolation.

To ensure that the cup spring, which extends essentially at a right angle to the axis of the connecting device when installed, can move freely, the first mounting element preferably has an inner radial bead for positioning the spring and which demarcates, in conjunction with the untensioned spring, a V-shaped gap that commences at the positioning bead and opens radially outward. Such a design allows the spring to move freely back and forth axially.

To further extend the life of the connecting device, the cushion can be rounded off from its outer and/or inner circumferential surface toward the supporting surfaces. It is possible to have corners slope at an angle. This design will ensure an effective load on the cushion even in the presence of vibrations at a right angle to its axis.

This design will extensively prevent the cushion from tilting between the two mounting elements in operation. The cushion should not extend radially beyond the first mounting element. The cushion will accordingly, like the first mounting element, be far enough from the axial projection on the second mounting element to prevent impeding the isolation or suppression of vibrations introduced at an angle to the axis.

The preferred embodiment of the present invention will now be described with reference to the accompanying drawings.

DESCRIPTION OF THE PREFERRED EMBODIMENT

Figure 1:
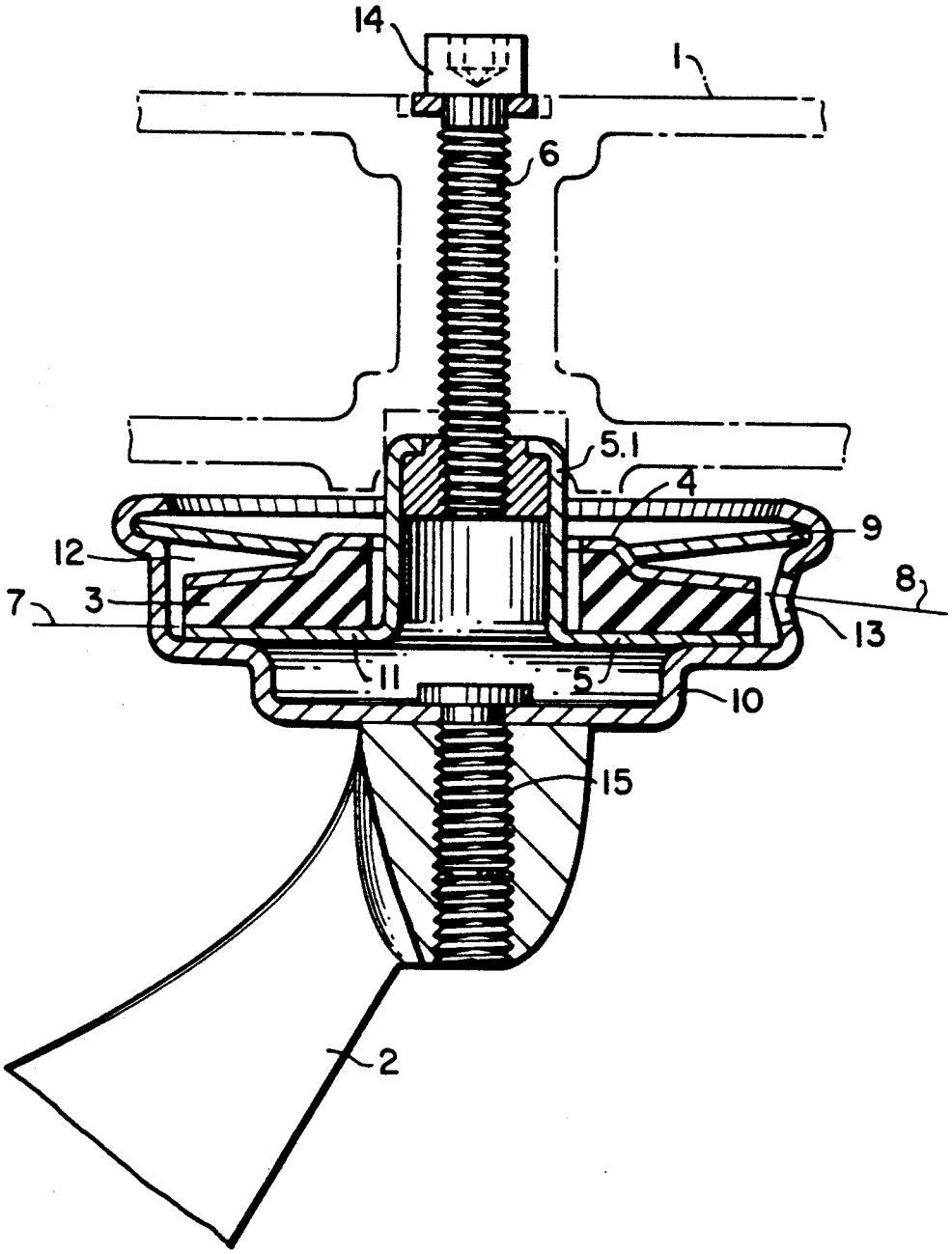
FIG. 1 is a cross-sectional view showing a resilient connecting device in accordance with the present invention in the untensioned state.
Figure 2:
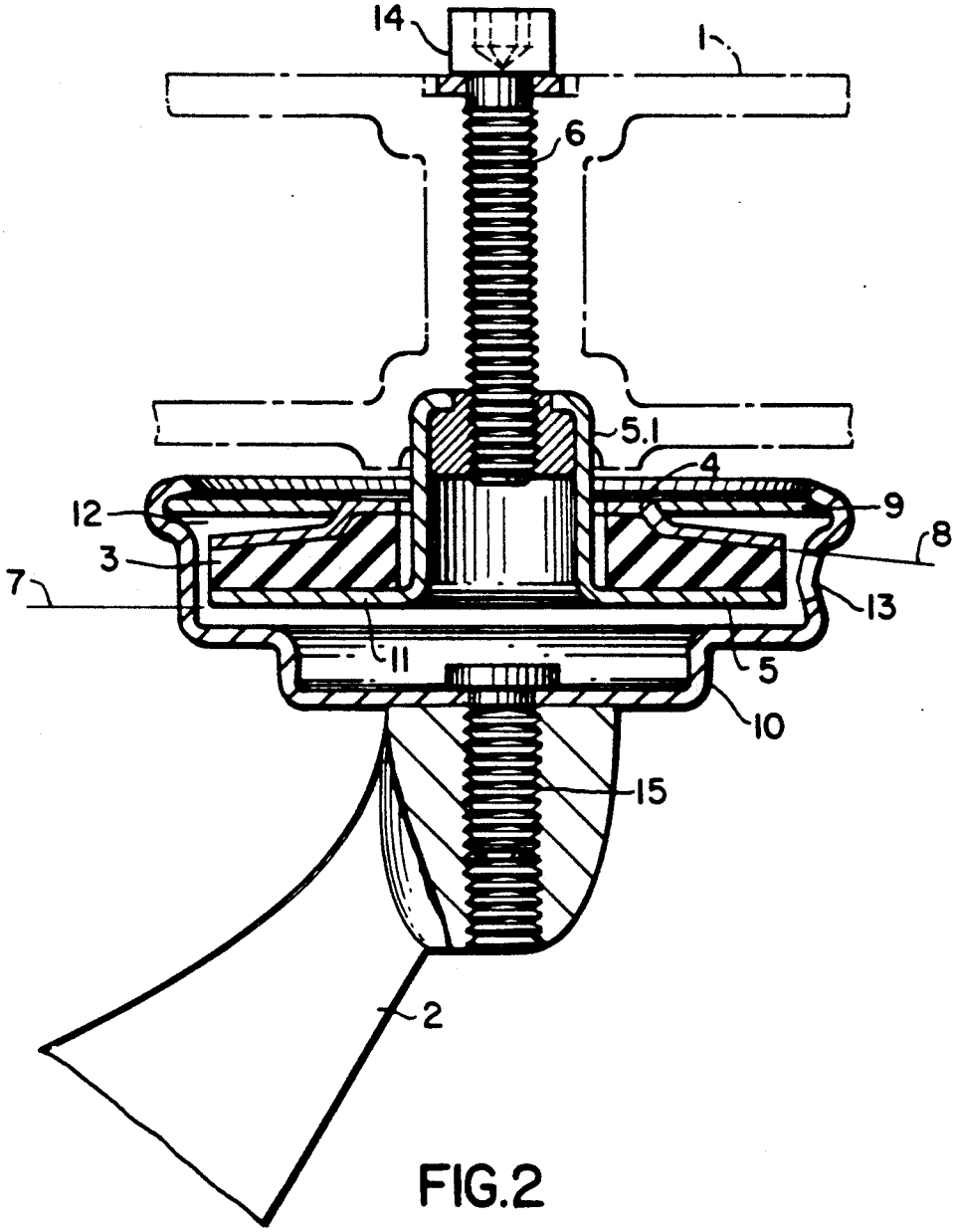
FIG. 2 is a cross-sectional view showing connecting device of FIG. 1 in operation and subject to tension.

Referring to FIGS. 1 and 2, a schematically illustrated intake pipe 1 communicates with an internal combustion engine 2, of which only the holding element is illustrated, by way of a connecting device that essentially comprises a resilient annular cushion 3 sandwiched between two mounting elements 4 and 5. The mounting elements are coaxial with the cushion and come into contact with its two supporting surfaces 7 and 8. A cup spring 9 is also coaxially aligned with the cushion 3. To prolong the life of the component and help it operate more effectively, the spring 9 is made of metal.

The connecting device illustrated in FIG. 1 is untensioned. The second mounting element 5 is in axial contact with a supporting fitting 10 that axially overlaps the mounting elements 4 and 5 and the cushion 3. The spring 9, which rests in the fitting 10 and against the first mounting element 4 is more or less flat in this unstressed state. The cushion 3 itself is extensively untensioned between the mounting elements 4 and 5.

The connecting device can be tensioned with a screw 14 that connects with second mounting element 5. The screw 14 in one preferred embodiment extends through a threaded section rigidly accommodated at the center of a pot-shaped axial projection 5.1 on the second mounting element 5. The fitting 10 is secured by another screw 15 to the holding element on the engine 2.

FIG. 2 illustrates the resilient connecting device shown in FIG. 1 in operation and subject to tension. The screw 14 has been tightened to adjust the position of the second mounting element 5, the cushion 3, the first mounting element 4, and the spring 9 in relation to the holding element on the engine 2, the fitting 10, and the intake pipe 1. The projection 5.1 on the second mounting element 5 now rests in a recess in the intake pipe 1. The connecting device will be particularly easy to mount if the recess also functions as a motion limiter. The spring characteristic of the spring 9 is essentially zero in the illustrated position once the desired tension has been established. This embodiment, in conjunction with an S-shaped characteristic of the spring 9, will ensure very satisfactory isolation of high-frequency vibrations, and the connecting device will have a long life without relaxation. The second mounting element 5 will be far enough from the axis of fitting 10 to keep the two components apart while the connecting device is in operation. Consequently, there will be no clatter. It is, of course, also possible to position resilient elevations on the facing surfaces of the fitting 10 and the second mounting element 5 to prevent extreme displacement and eliminate even more clatter.

As shown in FIGS. 1 and 2, the supporting fitting has a plurality of air outlets 13 distributed along its circumference in the axial vicinity of the cushion. As shown in FIG. 1, the mounting element 4 has an inner radial bead or crimping 11 for positioning the spring 9 and which demarcates, in conjunction with the untensioned spring 9, a V-shaped gap that commences at the positioning bead and opens radially outward. The V-shaped gap between the first mounting element 4 and the almost horizontal spring 9 allows axial displacement of the connecting device in both directions.

Figure 3:
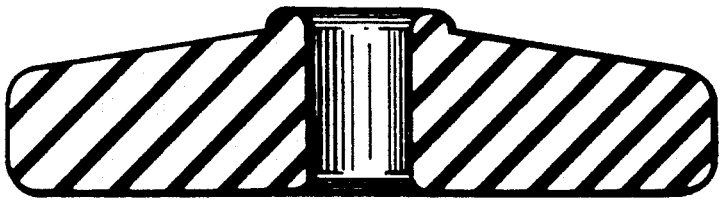
FIG. 3 is a detailed view of the cushion employed in the connecting device of FIGS. 1 and 2.

The cushion 3 is preferably rounded off from its outer and/or inner circumferential surfaces toward the respective supporting surfaces. This feature is shown in detailed in FIG. 3.

Preferably also, the cushion 3 does not extend radially beyond the mounting element 4, as shown in FIGS. 1 and 2.

The essential advantages of the resilient connecting device between an internal combustion engine and an intake pipe in accordance with the invention are simple assembly, few parts, long life, and reliability.

There has thus been shown and described a novel resilient connecting device between an internal combustion engine and an intake pipe that fulfills all the objects and advantages sought therefor. Many changes, modifications, variations, and other uses and applications of the subject invention will, however, become apparent to those skilled in the art after considering this specification and the accompanying drawings, which disclose the preferred embodiment thereof. All such changes, modifications, variations, and other uses and applications that do not depart from the spirit and scope of the invention are deemed to be covered by the invention, which is to be limited only by the claims that follow.

What is claimed is:

1. In a resilient connecting device between an internal combustion engine and an intake pipe, said connecting device comprising an annular cushion of resilient material and two mounting elements that are coaxial with the cushion, the improvement wherein the cushion is axially demarcated at each face by supporting surfaces that extend essentially perpendicular to the cushion axis, wherein the two mounting elements overlap and contact, respectively, the supporting faces, the cushion and mounting elements being connected to the intake pipe, and wherein a cup spring engages one of the mounting elements and is made of a material that does not creep, said cup spring being coaxial with the annular cushion and engaging a supporting fitting secured to the engine.

2. The connecting device defined in claim 1, wherein the tension on the cup spring is essentially zero in an installed position.

3. The connecting device defined in claim 1, wherein the cup spring is made of a material selected from the group consisting of fiber-reinforced plastic and steel.

4. The connecting device defined in claim 1, wherein a pot-shaped axial projection on one of said mounting elements extends essentially through the center of the other mounting element without coming into contact with it.

5. The connecting device defined in claim 1, wherein the cup spring is accommodated both on a side of one of said mounting elements, said side facing away from the cushion, and in the supporting fitting, said fitting extending axially along the two mounting elements and the cushion.

6. The connecting device defined in claim 5, wherein the supporting fitting has at least one air outlet distributed along its circumference in the axial vicinity of the cushion.

7. The connecting device defined in claim 1, wherein said one mounting element has an inner radial bead for positioning the spring which demarcates in conjunction with the cup spring a V-shaped gap that commences at the positioning bead and opens radially outward.

8. The connecting device defined in claim 1, wherein the cushion is rounded off from its outer circumferential surface toward the supporting surfaces.

9. The connecting device defined in claim 1, wherein the cushion is rounded off from its inner circumferential surface toward the supporting surfaces.

10. The connecting device defined in claim 1, wherein the cushion does not extend radially beyond said one mounting element.

* * * * *